United States Patent [19]

Ujhelyi

[11] Patent Number: 4,481,751

[45] Date of Patent: Nov. 13, 1984

[54] BAG BALING PROCESS

[75] Inventor: Gaspar Ujhelyi, Fairfield, N.J.

[73] Assignee: Potdevin Machine Company, Teterboro, N.J.

[21] Appl. No.: 288,140

[22] Filed: Jul. 29, 1981

[51] Int. Cl.[3] ..... B65B 11/08; B65B 35/52; B65B 61/18

[52] U.S. Cl. ..... 53/412; 53/446; 53/447; 53/466; 53/541; 414/96

[58] Field of Search ..... 53/412, 446, 465, 466, 53/447, 541; 198/436; 414/52, 96

[56] References Cited

U.S. PATENT DOCUMENTS

| | | | |
|---|---|---|---|
| 2,057,121 | 10/1936 | Trevellyan | 53/412 |
| 2,332,316 | 10/1943 | Hexter | 53/516 |
| 2,538,564 | 1/1951 | Jensen | 53/466 X |
| 2,659,187 | 11/1953 | Barnes | 53/446 |
| 2,703,653 | 3/1955 | Thompson | 414/46 X |
| 3,143,223 | 8/1964 | McIntyre | 53/541 X |
| 3,503,175 | 3/1970 | Marasso | 53/412 |
| 3,550,349 | 12/1970 | Kerker | 53/529 |
| 3,619,976 | 11/1971 | Kerker | 53/528 |
| 3,771,280 | 11/1973 | Bechle | 53/461 |

FOREIGN PATENT DOCUMENTS

| | | | |
|---|---|---|---|
| 1368722 | 6/1964 | France | 198/436 |
| 916320 | 1/1963 | United Kingdom | 53/412 |

*Primary Examiner*—John Sipos

*Attorney, Agent, or Firm*—Kane, Dalsimer, Kane, Sullivan and Kurucz

[57] ABSTRACT

A method for the stacking of bags received from a bag making machine which includes providing for the orientated transportation of hands of bag to a stack elevator which in conjunction with pusher means positions the hands of bags to form two or more adjacently positioned stacks of bags in an end to end but spaced relationship. The adjacent stacks are wrapped in a wrapping material to form a bale having provided therein a tear zone which allows for the ready separation of the stacks in pouches by the application of a force thereon with said wrapping material maintaining the integrity of the separate stacks.

8 Claims, 10 Drawing Figures

BAG BALING PROCESS

CROSS REFERENCE TO RELATED APPLICATION

This application relates to a method of producing bales of bags, particularly of the type as set forth in a copending application entitled "Bag Packaging" filed contemporaneously herewith.

FIELD OF THE INVENTION

The present invention relates to a method of baling bags and similar substantially flat items.

BACKGROUND OF THE INVENTION

There presently exists bag baling on bundling apparatus such as those set forth in commonly assigned U.S. Pat. No. 3,550,349 issued Dec. 29, 1970 and U.S. Pat. No. 3,619,976 issued Nov. 16, 1971. While apparatus of this type and the techniques involved have been found very satisfactory in many applications, it has become desirous to improve upon the techniques disclosed therein and provide for the formation of an alternate type of bag bale as set forth in a copending application aforementioned.

SUMMARY OF THE INVENTION

Accordingly, it is an object of this invention to provide for a method of forming a bag bale with the bale being compact and compressed occupying a minimum amount of space serving the needs of the trade.

It is another object of the invention to provide for a method of wrapping the bale so that it is separable into two or more separate stacks with the wrapping material maintaining the integrity of each stack separately and allowing access to the individual bags in the stacks.

The aforenoted objects and advantages, among others are effectively attained by a method of forming the bag/bale as hereinafter described. In this regard, individual bags are formed by a bag machine, and stacked on the delivery table at the discharge end of the bag making machine and move in individual hands by pick up finger of the bag packaging machine. These hands have the individual bags orientated in the same manner, that being the bag tops for each bag overlap the top of the bags therebelow in the stack. The stacks are compressed and transported to a stack elevator which alternates the orientation of each stack and forms two adjacent stacks of bags formed from the individual stacks transported to the stack elevator. Two adjacent stacks may then be compressed and provided with a wrapping material thereabout with the ends of the wrapping material sealed in a flap fashion. A perforated, or slitted line, or tear strip is provided in the wrapping material at a point in the material between the stacks so as to allow the now single bale to be separated into multiple stacks with the individual bags being exposed at one of their ends. A portion of the wrapping material between the stacks may remain intact so that the stacks may be folded back at that point or alternatively and somewhat preferably the tear zone may extend entirely about the bale so that the multiple stacks may be separated entirely from each other.

DETAILED DESCRIPTION OF THE PREFERRED EMBODIMENT

Figure 1:
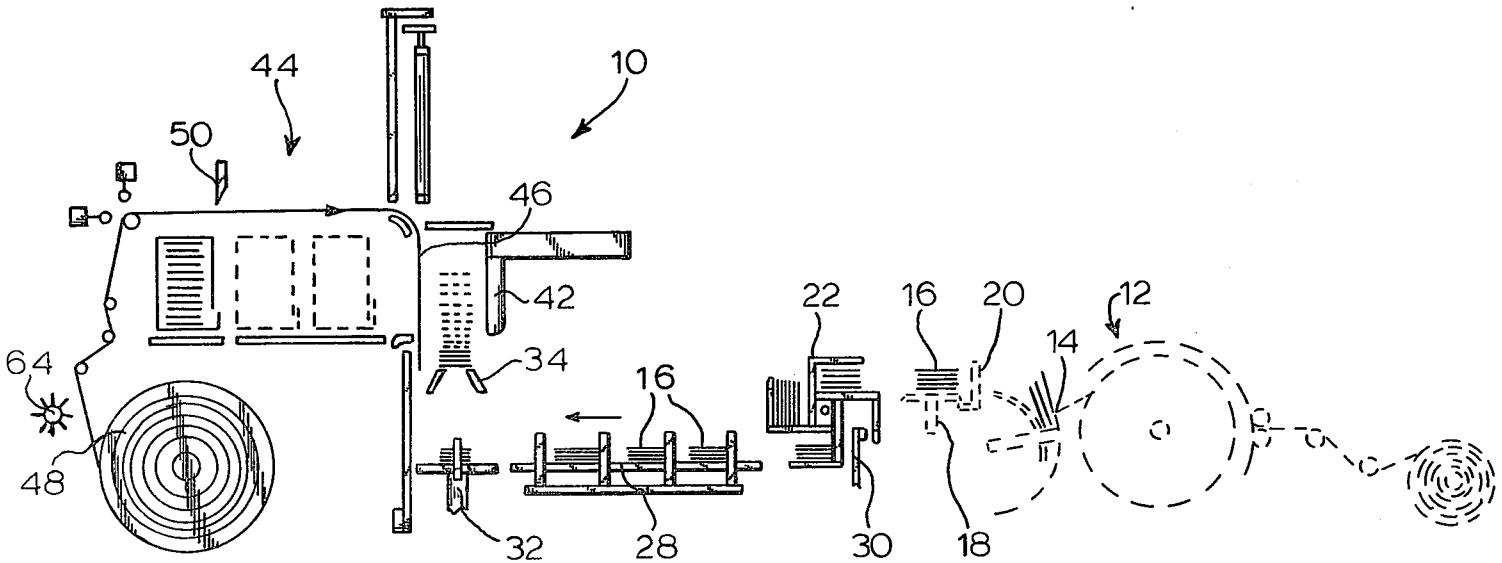
FIG. 1 is an overall schematic view of a paper bag baling apparatus incorporating the method of the present invention coupled with a paper bag making machine shown in phantom.

A general illustration of the apparatus utilized in performing the method as hereinafter described is illustrated in FIG. 1. In this regard, a paper bag baling machine 10 is shown coupled with a paper bag making machine 12. It includes a pick up finger 14 which operates to remove bags as they are produced by the bag making machine 12. When a desired number of bags has been collected, (termined hand 16) the pick up fingers transfers and positions the hand 16 on a turntable 18 which is adapted to orientate the stacks in a manner desired with a pusher mechanism 20 pushing the orientated stacks 16 onto a transfer compressor 22 which is adapted to compress and invert the hand 16 so that the bottom of each bag of the stack faces upward to allow inspection of the bags as they proceed along the inspection conveyor.

The compressed hand 16 are now pushed onto a stack inspection conveyor 28 by a pusher 30.

Figure 2:
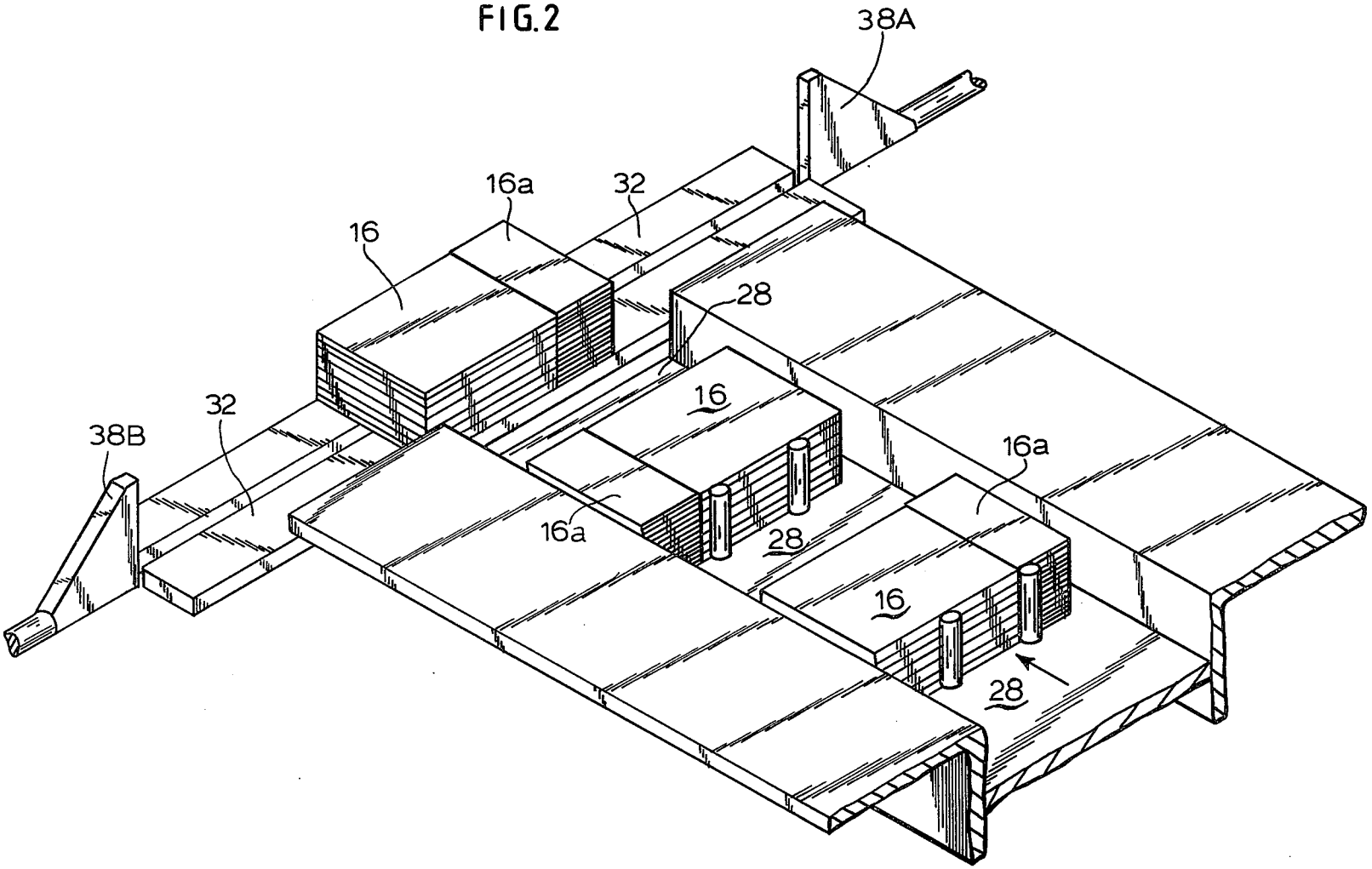
FIG. 2 is a perspective view of the individual stacks of bags being fed to the stack elevator or lifter incorporating the teachings of the present invention.

Reference to FIG. 2 shows the hands 16 located on the inspection conveyor 28 with the bottom folded over end of each bag designated 16*a*. As can be seen on the inspection conveyor 28, the hands 16 are formed with the bottom end 16*a* of the individual bags arranged in an overlapping fashion, and the hands 16 are fed with the position of the bottom of the bags 16*a* orientated in an alternating fashion as they are fed to the discharge end of the inspection conveyor 28 may vary as desired as will later become apparent.

Figure 4:
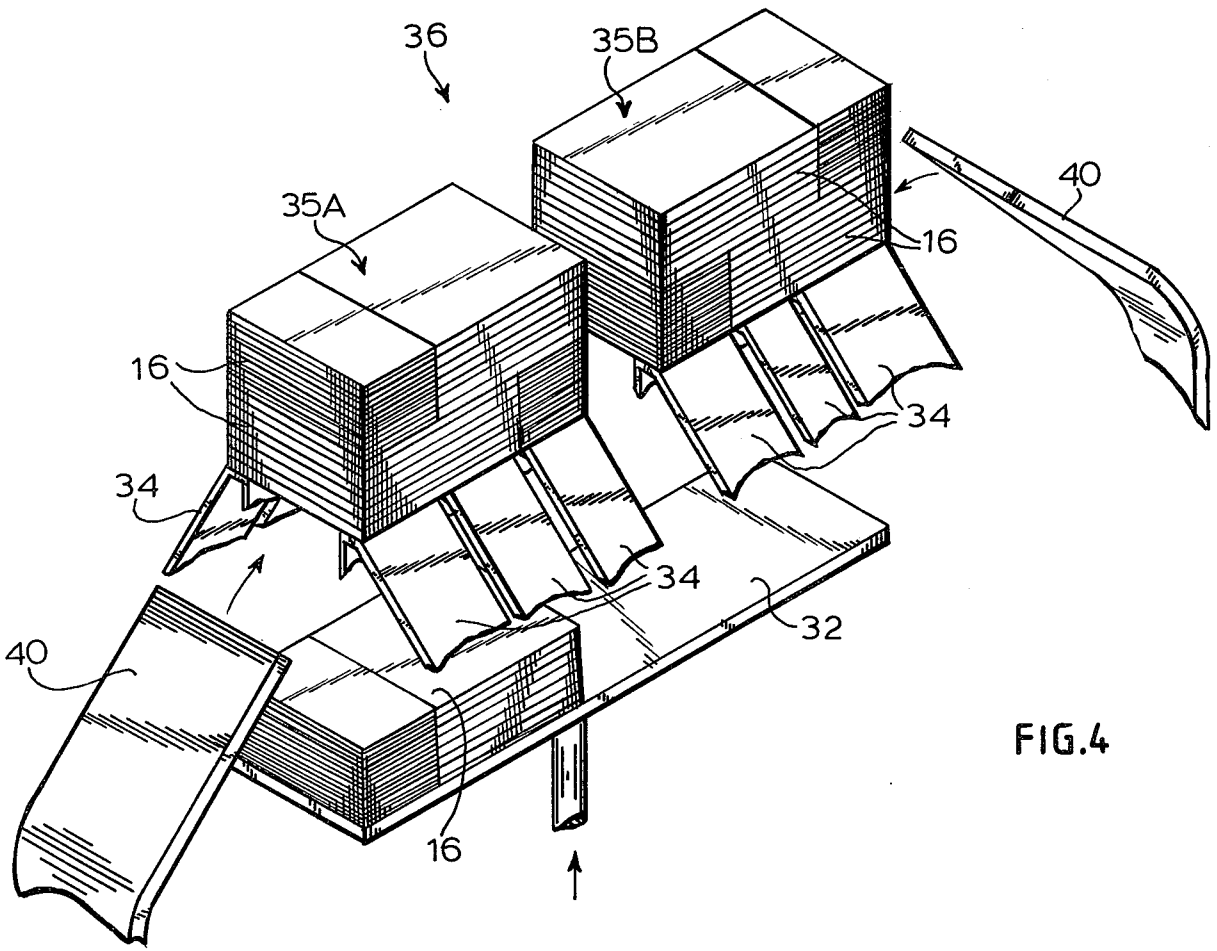
FIG. 4 is a perspective view of elevated stacks of bags on the holding gates with another stack being formed on the stack lifter.

At the discharge end of the inspection conveyor 28, the hands 16 are transferred onto a platform of a stack lifter mechanism 32 which elevates the hands 16 to an elevated holding gates 34 on which a predetermined number of hands are accumulated to form stacks 35A and 35B as set forth in FIG. 4.

Figure 3A:
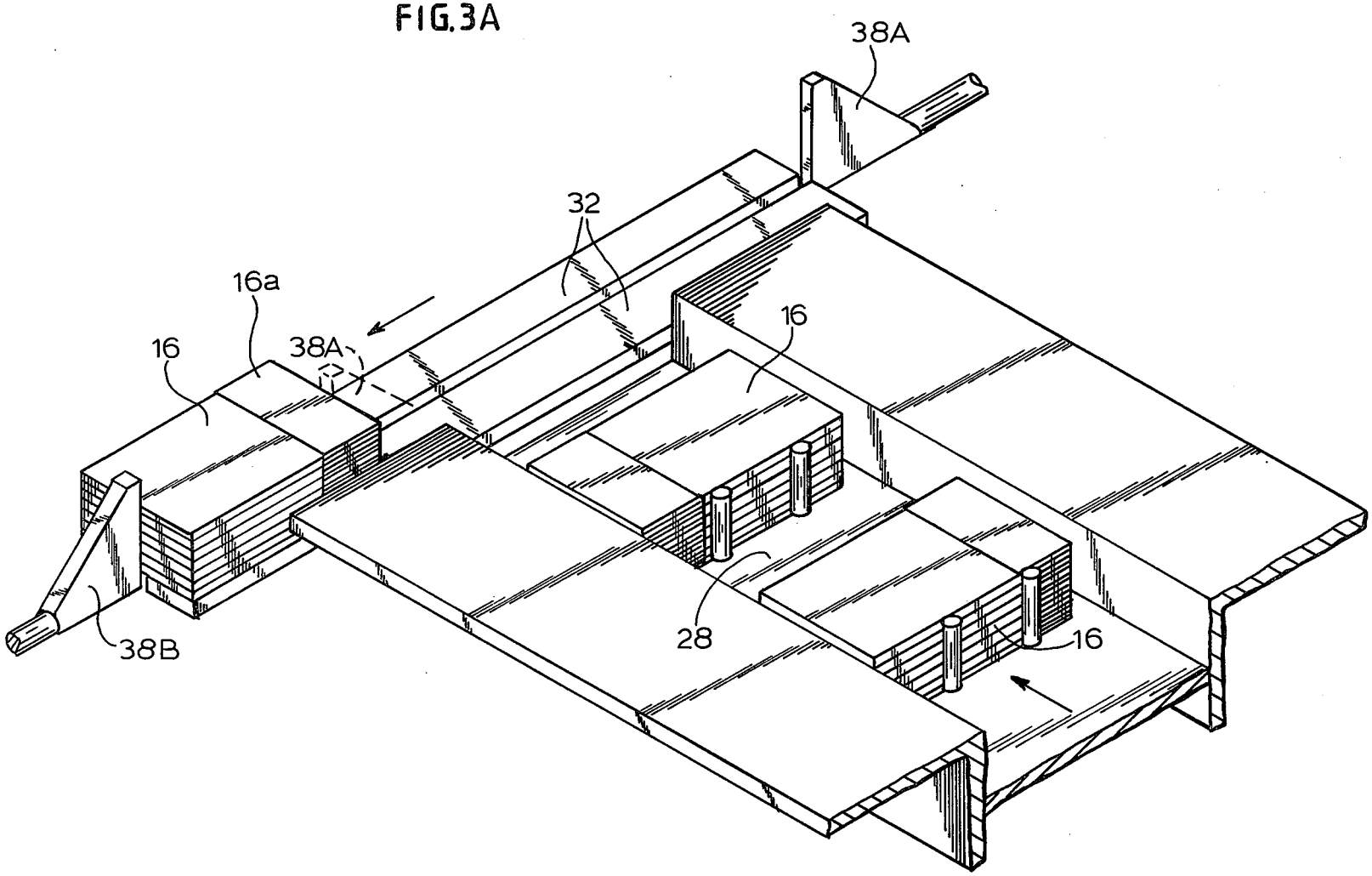
FIG. 3A is a perspective view of the formation of an individual stack of bags with one hand positioned one side of the stack lifter in a manner incorporating the teachings of the present invention.
Figure 3B:
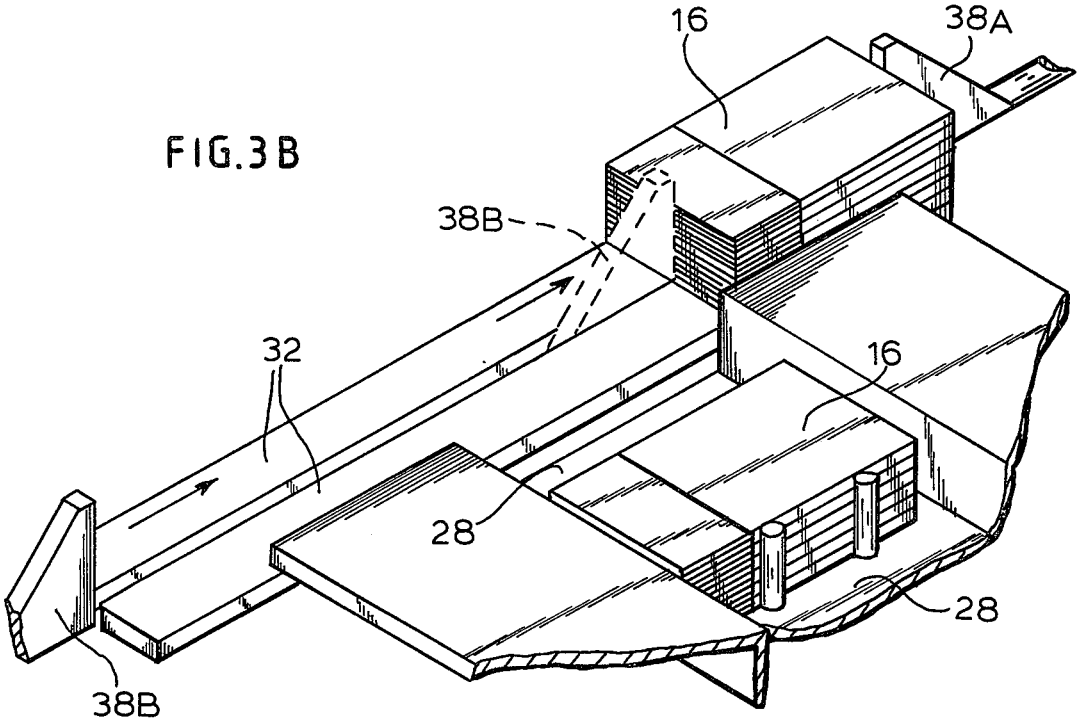
FIG. 3B is a similar view with a hand of bags at the other side of the stack lifter initiating the formation of the neighboring stack.
Figure 6:
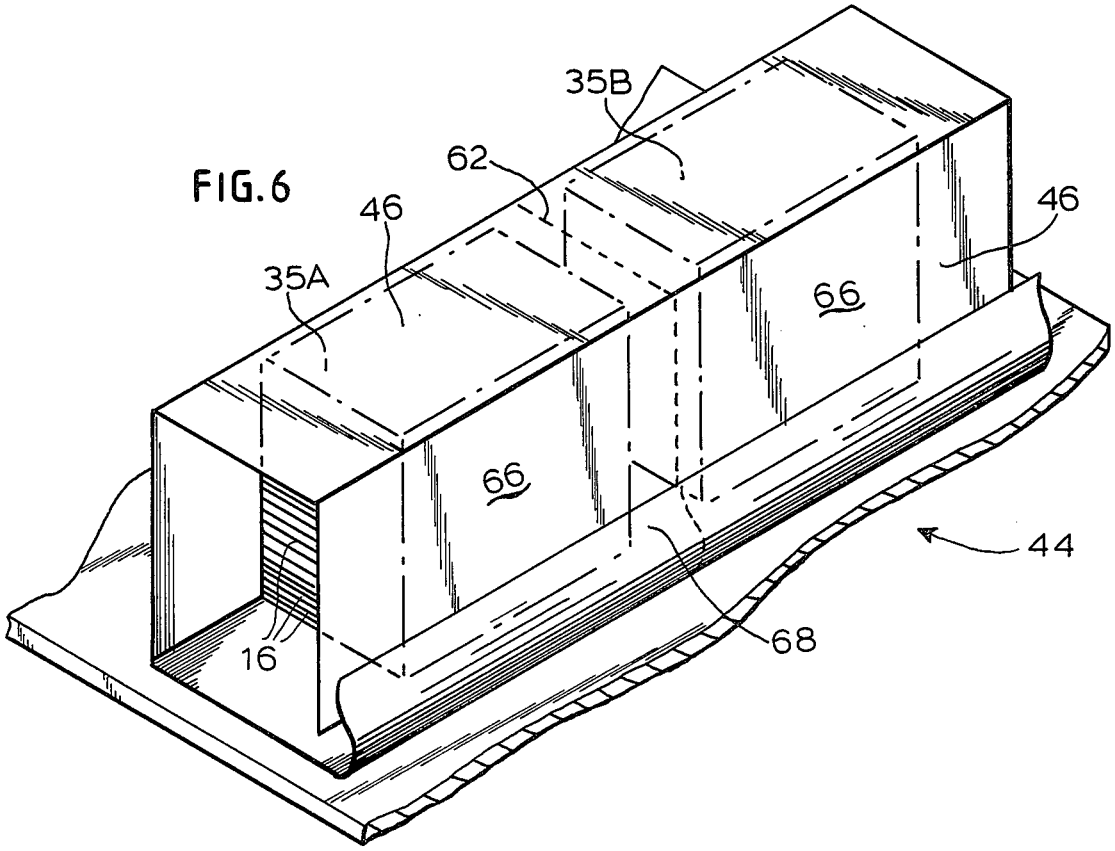
FIG. 6 is a perspective view of the wrapping material placed about the two individual stacks of bags shown in phantom therein, just prior to having the bottom end of the wrapping material pressed against the top end into a seal by a glue flap folding plate.

Reference is made to FIGS. 3A and 3B in which alternating pushers 38A and 38B shift the position of the individual hands 16 after they are discharged onto the stack lifter 32 from inspector conveyor 28, so as to be off-centered prior to being elevated to the holding gates 34. This allows a build-up in sequence of two or more independently formed stacks shown in FIGS. 4 and 5. In this connection, hands 16 of bags discharged on the stack lifter 32 are pushed off-center to the left by pusher 38A until the desired number of hands are raised and held on holding gates 34 to form stack 35A. Thereafter the hands 16 are pushed off-center to the right by the pusher 38B and then elevated onto the holding gates 34 to form adjacent stack 35B. This allows the bale 36 to be formed. These adjacent stacks 35A and 35B are positioned in an end-to-end relationship with a small space therebetween as shown.

Upon the accumulation of a predetermined number of stacks 35A and 35B which when wrapped will constitute bale 36, lifting fingers 40 lift and compress the accumulated stacks to a position where a pusher mechanism 42 pushes the compressed bundle into a wrapping station 44.

At the wrapping station 44 an outer wrapping material is applied about the compressed stacks 35A and 35B. In this regard, reference is made to FIG. 5 which shows the stacks 35A and 35B prior to being pushed into the wrapping station 44. As can be seen in conjunction with FIG. 1, a wrapping material 46; which may be a sheet material made of perhaps paper, is positioned between the wrapping station 44 and the stacks. Note that the feeding of this material 46 and its support by the wrapping station 44 is discussed more fully in U.S. Pat. Nos. 3,550,349 and 3,619,976 and accordingly will just briefly be dealt with herein. A predetermined length of this material is fed from a web 48 and is guided into position at wrapping station 44. A predetermined length of the material 46 is severed from the web 48 by a knife arrangement 50.

Figure 5:
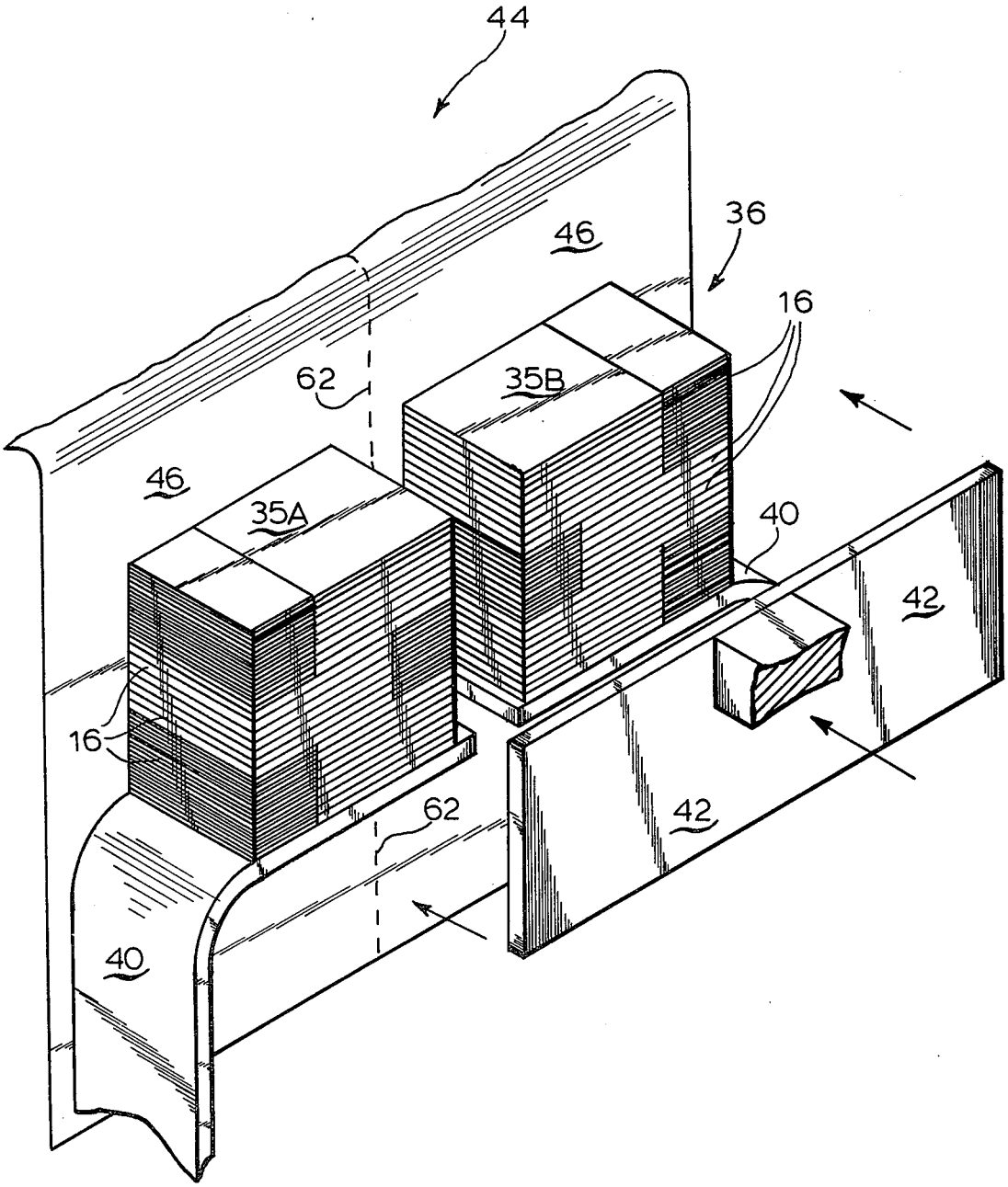
FIG. 5 is a perspective view of two separate stacks of bags adjacently positioned on swing arms just prior to being transferred into the wrapping material.

Upon being pushed onto the wrapping station 44 and in contact with the length of material 46, the material takes the shape about the bundle as shown in FIG. 5, which includes being positioned about the four longitudinal sides of the stacks 35A and 35B with a portion extending beyond the two opposite vertical ends of the stacks. In this position, the top trailing end of the material 46 is positioned adjacent to its bottom leading flap and upon application of an adhesive therebetween may be subsequently adhesively joined upon application of a suitable pressing force as disclosed in the above referenced patents.

The wrapping material 46 is provided with a tear zone 62 centrally located with respect to the width of material 46 and centrally of the spacing between the stacks 35A and 35B. This tear zone may be provided by perforations or slits placed in the web 48 by way of perforating wheel 64 adapted to engage the web 48 as it is being fed from the supply roll.

Alternatively, the tear zone may be provided by a tear strip or tape similarly positioned in the material which allows for a separation of material upon exerting a tearing or separating force thereon.

Figure 8:
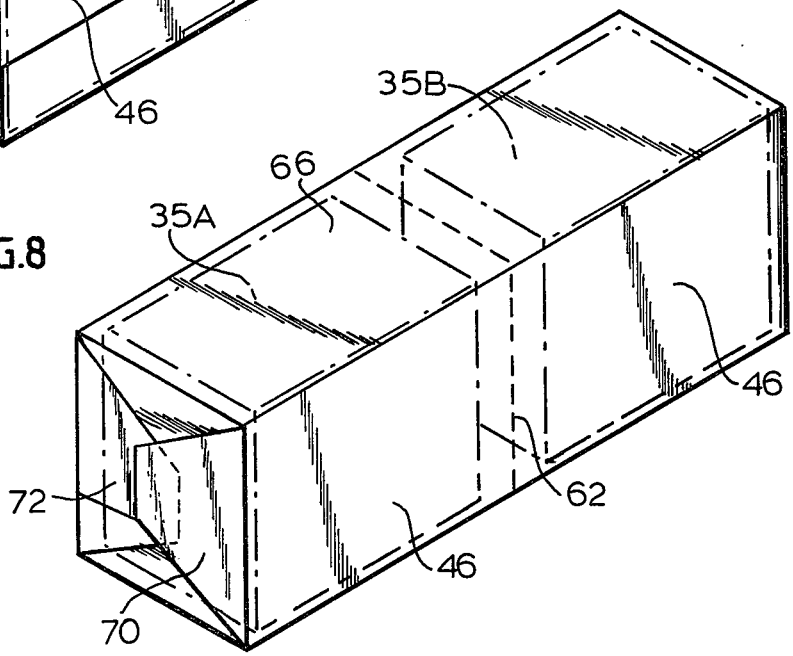
Figure 9:
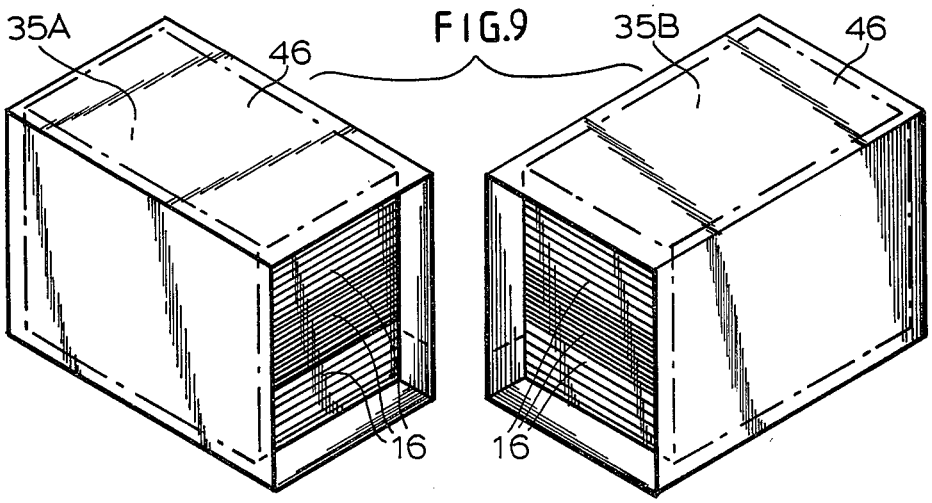
FIG. 9 is a perspective view of a bag bale formed in accordance with the teachings of the present invention whereby the bale has been separated along a tear zone in the wrapping material allowing the separation of the two stacks exposing the ends of the individual bags contained in each stack.

The tear zone 62 may preferably extend the entire length of material 46 to allow a total separation of the two adjacent pouches each containing a stack of bags as shown. Alternately, a portion of the length of material 46 may only be slitted so as to allow a folding back of the two adjacent pouches of stacks as shown in FIG. 8, with an unperforated portion of the material 46 holding the stacks together. This may be accomplished by having the perforating wheel 64 operate intermittently leaving a section along the length of material 46 unperforated or have a tear tape only on a portion of the length of material 46.

Figure 7:
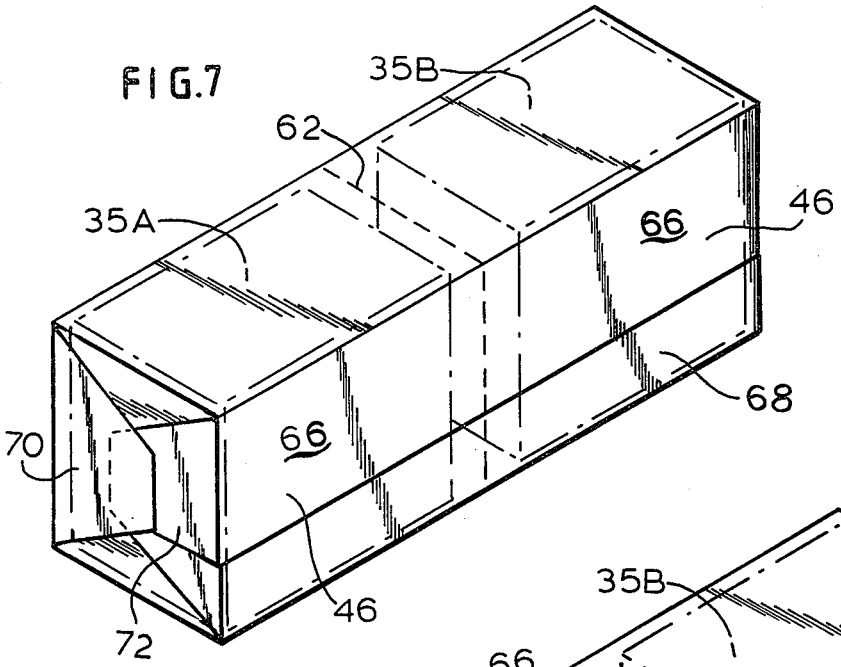
FIGS. 7 and 8 are perspective views of the single bale of bags containing the two individual stacks therein shown in phantom whereby the overextending portion of the wrapping material at each end is formed into overlapping flaps thereby sealing the ends of the bale.

Turning now to FIGS. 5 and 7, there is shown a partially wrapped bundle with overlapping top side flap 66 and bottom side flap 68. The projecting ends of the wrapping material 46 are thereafter folded in an overlapping relationship with perhaps an adhesive positioned therebetween to form end flaps 70 and 72. Note that the forming and folding of the end flaps may be performed as set forth in the commonly assigned U.S. Pat. No. 3,771,820 issued Nov. 13, 1973.

In summary, it is evident that the proposed method provides for the stacking of bags received from a bag making machine, and the formation of a desired bale of two or more adjacently positioned stacks of bags arranged in an end-to-end relationship wrapped in a wrapping material having provided thereon a tear zone which allows for the ready separation of the separate stacks of bags by the application of a force thereon with said wrapping material maintaining the integrity of the separate stacks upon separation in the form of pouches.

While a preferred embodiment has been disclosed and described in detail herein, it should be understood that the invention is by no sense limited thereby but rather its scope should be determined by that of the appended claims.

What is claimed is:

1. A method of providing a bale of bags which includes at least two separate but adjacent stacks of said bags, including the following steps:

arranging said bags in stacks to form hands;

feeding hands of stacked bags one at a time to a first position on a stack elevator;

pushing the first of said hands from the first position laterally to a second position toward one end of the elevator;

elevating said first hand with the elevator to a stack support means;

repeating said pushing and elevating steps with at least one more hand so that said hands are stacked to form a first stack of hands on said support means;

pushing the ensuing hands one at a time from said first position laterally to a third position toward the other end of the elevator;

elevating said ensuing hands one at a time to said stack support means adjacent said first stack of hands to form a second stack of hands on said support means and thus forming separate first and second stacks of bags which are adjacent each other in an end to end relationship defining a dividing line therebetween;

simultaneously lifting said adjacent first and second stacks of hands from said support means to a wrapping station;

providing wrapping material in said wrapping station and in a portion of said material a tear zone which facilitates the separation of said material; and wrapping said wrapping material about the outside of said stacks to maintain the integrity of each stack and their adjacent position so as to form a single bale with said tear zone substantially adjacent said dividing line whereby a package of substantially bags is formed comprising at least two separate stacks of a plurality of bags positioned so as to have an edge of each stack respectively adjacent to each other and so that upon separating the bale along the tear zone each of the two stacks of bags are readily accessible.

2. The method in accordance with claim 1 wherein said bags having top and bottom ends and further includes the step of forming said hand of bags with their top and bottom ends similarly orientated.

3. The method in accordance with claim 2 which further includes the step of forming said first and second stack by combining at least two hands respectively in a manner that the top end of one hand overlaps the bottom end of the adjacent hand of the stack.

4. The method in accordance with claim 1 which further includes the following steps:

wrapping said wrapping material about the outside of the first and second stacks with an overextended portion of said material provided beyond said stacks;

forming said overextended portion into a plurality of flaps; and folding over said flaps so as to seal the ends of the bale.

5. The method in accordance with claim 1 which further includes the step of forming said tear zone by providing a perforation in said wrapping material about a portion of said bale substantially adjacent said dividing line between the spaced stacks.

6. The method in accordance with claim 1 which further includes the step of forming said tear zone and providing a perforation in said wrapping material entirely about said bale substantially adjacent said dividing line.

7. The method in accordance with claim 8 which further includes the step of forming said tear zone by providing a perforation in said wrapping material about a portion of said bale substantially adjacent said dividing line.

8. The method in accordance with claim 8 which further includes the step of forming said tear zone and providing a perforation in said wrapping material entirely about said bale substantially adjacent said dividing line.

* * * * *